US011994132B2

(12) United States Patent
Wilcox

(10) Patent No.: US 11,994,132 B2
(45) Date of Patent: May 28, 2024

(54) THERMAL PROBE FOR MOTOR LEAD EXTENSION

(71) Applicant: Baker Hughes Oilfield Operations LLC, Houston, TX (US)

(72) Inventor: Spencer Wilcox, Claremore, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 31 days.

(21) Appl. No.: 17/590,652

(22) Filed: Feb. 1, 2022

(65) Prior Publication Data

US 2023/0243356 A1 Aug. 3, 2023

(51) Int. Cl.

| | |
|---|---|
| ***F04D 13/10*** | (2006.01) |
| ***E21B 43/12*** | (2006.01) |
| ***F04D 13/06*** | (2006.01) |
| ***F04D 15/00*** | (2006.01) |

(52) U.S. Cl.
CPC ..... *F04D 13/0693* (2013.01); *E21B 43/128* (2013.01); *F04D 13/10* (2013.01); *F04D 15/0088* (2013.01)

(58) Field of Classification Search
CPC ..... E21B 43/128; E21B 47/008; E21B 47/07; E21B 17/025; E21B 17/026; E21B 43/2406; F04D 13/10; F04D 13/021; F04D 13/0693; F04D 13/08; F04D 15/00; F04D 15/0088; F04D 15/0263; H02K 5/132; H02K 5/225; H02K 11/0094; H02K 3/30; H02K 3/345
See application file for complete search history.

(56) References Cited

U.S. PATENT DOCUMENTS

| | | | | |
|---|---|---|---|---|
| 5,983,908 | A * | 11/1999 | Bradley | A47L 15/20 134/201 |
| 6,837,621 | B1 | 1/2005 | Sakamoto | |
| 8,347,953 | B1 * | 1/2013 | Elizondo, Jr. | E21B 43/128 166/250.01 |
| 8,400,093 | B2 | 3/2013 | Knox et al. | |
| 10,823,177 | B2 | 11/2020 | Sheth et al. | |
| 11,208,876 | B2 | 12/2021 | Eslinger et al. | |
| 2010/0047089 | A1 * | 2/2010 | Booker | G01K 13/08 374/E7.004 |

(Continued)

FOREIGN PATENT DOCUMENTS

| | | | |
|---|---|---|---|
| CA | 2824176 | A1 | 2/2015 |
| WO | 2017184158 | A1 | 10/2017 |

OTHER PUBLICATIONS

International Search Report and Written Opinion for PCT/US2023/011961 dated Jul. 6, 2023.

*Primary Examiner* — Dominick L Plakkoottam
(74) *Attorney, Agent, or Firm* — Crowe & Dunlevy, P.C.

(57) ABSTRACT

An electric submersible pumping system is configured to produce fluids from a well. The submersible pumping system includes a motor drive, an electric motor driven by the motor drive, a sensor module and a power cable. An upper end of the power cable is connected to the motor drive. The electric submersible pumping system further includes a pothead connected to the motor and a motor lead extension, where an upper end of the motor lead extension is connected to the power cable and a lower end of the motor lead extension is connected to the motor through the pothead. The electric submersible pumping system includes a motor lead extension temperature sensor located in the pothead.

16 Claims, 2 Drawing Sheets

(56) References Cited

U.S. PATENT DOCUMENTS

| | | | | |
|---|---|---|---|---|
| 2012/0037354 | A1* | 2/2012 | McCoy | F04D 13/10 166/65.1 |
| 2012/0100014 | A1 | 4/2012 | Seitter | |
| 2012/0105230 | A1 | 5/2012 | Bockstoce | |
| 2012/0121224 | A1 | 5/2012 | Dalrymple et al. | |
| 2013/0272808 | A1 | 10/2013 | Cohen | |
| 2013/0272898 | A1* | 10/2013 | Toh | F04D 13/10 417/44.1 |
| 2015/0037171 | A1* | 2/2015 | Orrego | E21B 43/128 417/423.3 |
| 2015/0323392 | A1* | 11/2015 | Mori | B23K 31/02 374/165 |
| 2016/0024854 | A1* | 1/2016 | Clingman | H01R 13/6215 439/587 |
| 2016/0181884 | A1* | 6/2016 | Rumbaugh | H01R 13/523 310/71 |
| 2016/0252404 | A1* | 9/2016 | Terada | G01K 7/023 374/179 |
| 2016/0290126 | A1 | 10/2016 | Rendusara et al. | |
| 2017/0070119 | A1* | 3/2017 | Lee | H02K 5/22 |
| 2017/0194830 | A1 | 7/2017 | Poretti et al. | |
| 2017/0244294 | A1* | 8/2017 | Holzmueller | H02K 5/132 |
| 2018/0041086 | A1* | 2/2018 | Madbouly | H02K 3/34 |
| 2018/0090874 | A1* | 3/2018 | Frey | H01B 7/2813 |
| 2018/0262074 | A1 | 9/2018 | Duan | |

* cited by examiner

THERMAL PROBE FOR MOTOR LEAD EXTENSION

FIELD OF THE INVENTION

This invention relates generally to the field of submersible pumping systems, and more particularly, but not by way of limitation, to an improved monitoring system for measuring conditions within downhole pumping systems.

BACKGROUND

Submersible pumping systems are often deployed into wells to recover petroleum fluids from subterranean reservoirs. Typically, a submersible pumping system includes a number of components, including an electric motor coupled to one or more high performance pump assemblies. Production tubing is connected to the pump assemblies to deliver the petroleum fluids from the subterranean reservoir to a storage facility on the surface.

The motor is typically an oil-filled, high capacity electric motor that can vary in length from a few feet to nearly one hundred feet, and may be rated up to hundreds of horsepower. Typically, electricity is generated on the surface and supplied to the motor through a heavy-duty power cable. The power cable typically includes several separate conductors that are individually insulated within the power cable. Power cables are often constructed in round or flat configurations.

In many applications, power is conducted from the power cable to the motor via a "motor lead extension" or "motor lead cable." The motor lead extension typically includes one or more "leads" that are configured for connection to a mating receptacle on the motor. The leads from the motor lead extension are often retained within a motor-connector that is commonly referred to as a "pothead." The pothead relieves the stress or strain realized between the motor and the leads from the motor lead extension. Motor lead extensions are often constructed in a "flat" configuration for use in the limited space between downhole equipment and the well casing.

The motor lead extension is a relatively fragile component and is sensitive to being overheated during use. If the motor lead extension overheats, the insulators and seals can fail, which often leads to electrical shorts that render the cable inoperable. In some cases, the failure of the motor lead extension results in additional damage to the electric submersible pumping system.

In the past, the temperature of the motor lead extension has been indirectly monitored as a function of the temperature of the motor windings, which can be measured with a thermocouple located inside the motor. Because the motor lead extension can be dozens of feet away from the motor, this indirect method of monitoring the temperature of the motor lead cable can be imprecise and unreliable. There is, therefore, a need for an improved system and method for measuring the temperature within the motor lead extension.

SUMMARY OF THE INVENTION

In one aspect, embodiments of the present disclosure are directed to an electric submersible pumping system for use in recovering wellbore fluids from a wellbore. The submersible pumping system includes a motor drive, an electric motor driven by the motor drive, a sensor module connected to the electric motor, and a power cable, where an upper end of the power cable is connected to the motor drive. The electric submersible pumping system further includes a motor lead extension and a pothead connected between the motor lead extension and the electric motor. The electric submersible pumping system includes a motor lead extension temperature sensor located outside the motor. The motor lead extension temperature sensor is configured to measure the temperature of the motor lead extension and output a motor lead extension temperature signal to the sensor module.

In another aspect, embodiments of the present disclosure are directed to an electric submersible pumping system configured to produce fluids from a well. The submersible pumping system has a motor drive, an electric motor driven by the motor drive, a sensor module, and a power cable, where a first end of the power cable is connected to the motor drive. The electric submersible pumping system further includes a pothead connected to the motor and a motor lead extension, where a first end of the motor lead extension is connected to a second end of the power cable, and where a second end of the motor lead extension is connected to the motor through the pothead. The electric submersible pumping system further includes a motor lead extension temperature sensor located in the pothead.

In yet another embodiment, the present disclosure is directed to a method for operating an electric submersible pumping system that includes an electric motor, a motor drive, a power cable connected to the motor drive, and a motor lead extension connected through a pothead between the electric motor and the power cable. The method begins with the steps of providing a motor lead extension temperature sensor external to the electric motor. Next, the method includes the step of measuring a temperature of the motor lead extension with the motor lead extension temperature sensor. Lastly, the method includes the step of outputting a motor lead extension temperature signal to a sensor module

DETAILED DESCRIPTION

Figure 1:
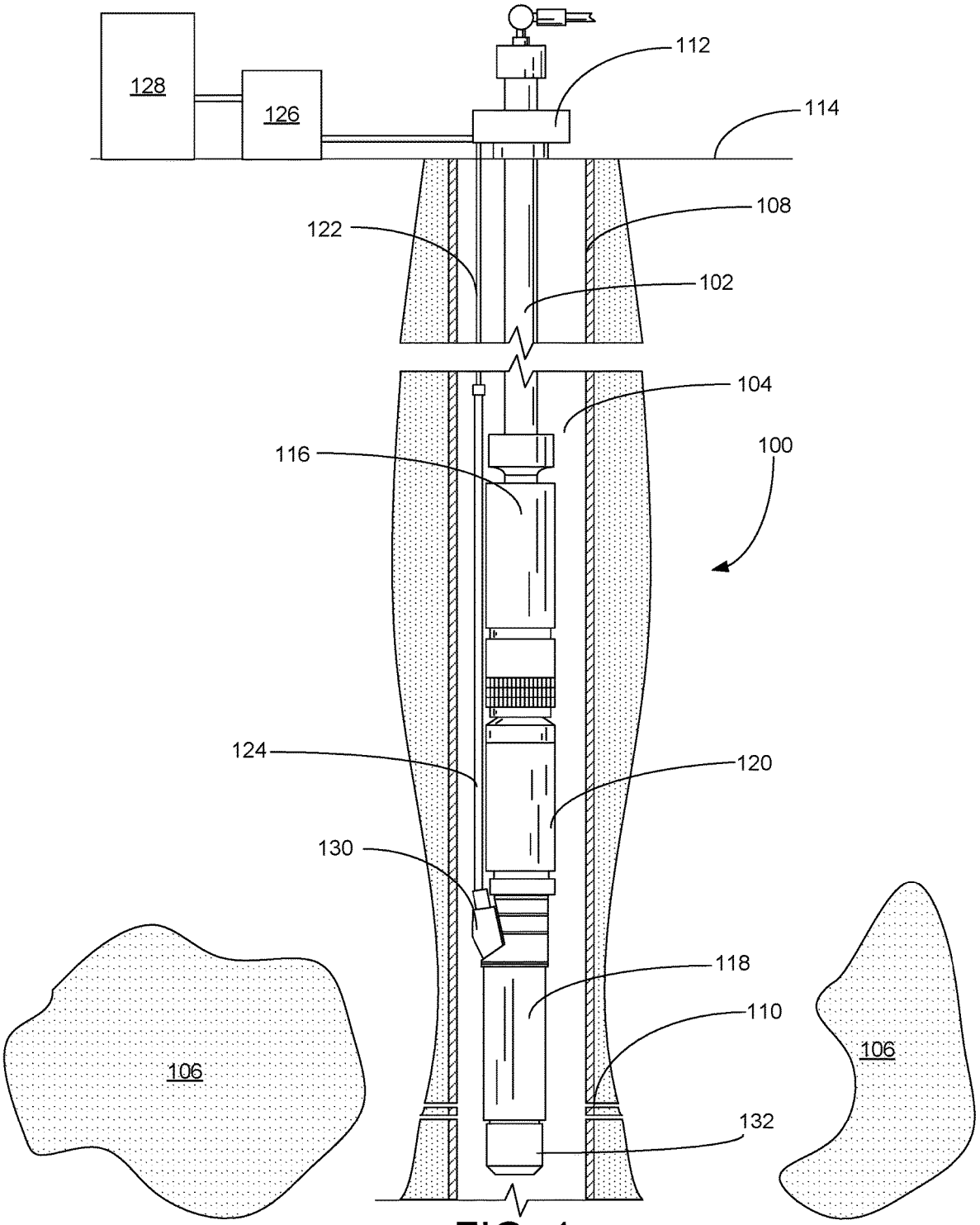
FIG. 1 is an elevational depiction of an electric submersible pumping system.

In accordance with an exemplary embodiment of the present invention, FIG. 1 shows a front view of a downhole pumping system 100 attached to production tubing 102. The downhole pumping system 100 and production tubing 102 are disposed in a wellbore 104, which is drilled for the production of a fluid such as water or petroleum from a subterranean geologic formation 106.

The wellbore 104 includes a casing 108, which has perforations 110 that permit the exchange of fluids between the wellbore 104 and the geologic formation 106. Although the downhole pumping system 100 is depicted in a vertical well, it will be appreciated that the downhole pumping system 100 can also be used in horizontal, deviated, and other non-vertical wells. Accordingly, the terms "upper" and "lower" should not be construed as limiting the disclosed embodiments to use in vertical wells.

The production tubing 102 connects the pumping system 100 to a wellhead 112 located on the surface 114, which may be onshore or offshore. Although the pumping system 100 is primarily designed to pump petroleum products, it will be understood that the present invention can also be used to move other fluids. It will also be understood that, although each of the components of the pumping system 100 are primarily disclosed in a submersible application, some or all of these components can also be used in surface pumping operations.

The pumping system 100 includes a pump 116, a motor 118 and a seal section 120. The motor 118 is an electric motor that receives its power from a surface-based supply through a power cable 122 and one or more motor lead extensions 124. In many embodiments, the power cable 122 and motor lead extension 124 are configured to supply the motor 118 with three-phase electricity from a surface-based variable speed (or variable frequency) motor drive 126, which receives electricity from a power source 128. The electricity is carried along separate conductors (not separately designated), which each correspond to a separate phase of the electricity. The motor lead extension 124 connects to the motor 118 through a connector 130, which is often referred to as a "pothead" connector. The motor lead extension 124 extends into the pothead 130, where it terminates in a connection to the conductor leads of the motor 118. The pothead connector 130 relieves mechanical stresses between the motor lead extension 124 and the motor 118, while providing a sealed connection that prevents the ingress of wellbore fluids into the motor 118, motor lead extension 124, or pothead 130.

The motor 118 converts the electrical energy into mechanical energy, which is transmitted to the pump 116 by one or more shafts. The pump 116 then transfers a portion of this mechanical energy to fluids within the wellbore 104, causing the wellbore fluids to move through the production tubing 102 to the surface 114. In some embodiments, the pump 116 is a turbomachine that uses one or more impellers and diffusers to convert mechanical energy into pressure head. In other embodiments, the pump 116 is a progressive cavity (PC) or positive displacement pump that moves wellbore fluids with one or more screws or pistons.

The seal section 120 shields the motor 118 from mechanical thrust produced by the pump 116. The seal section 120 is also configured to prevent the introduction of contaminants from the wellbore 104 into the motor 118, while also accommodating the thermal expansion and contraction of lubricants within the motor 118. Although only one pump 116, seal section 120 and motor 118 are shown, it will be understood that the downhole pumping system 100 could include additional pumps 116, seal sections 120 or motors 118.

The pumping system 100 also includes a gauge or sensor module 132 connected to the motor 118. As depicted in FIG. 1, the motor 118 is positioned between the sensor module 132 and the seal section 120. In other embodiments, the sensor module 132 can be located elsewhere in the pumping system 100, for example, between the motor 118 and the seal section 120. The sensor module 132 may include internal sensors and circuits for receiving and processing signals from remote sensors configured to measure operational and environmental conditions at the pumping system 100, as well as communications circuits for transmitting and receiving data from equipment located on the surface 114 or elsewhere in the wellbore 104.

Figure 2:
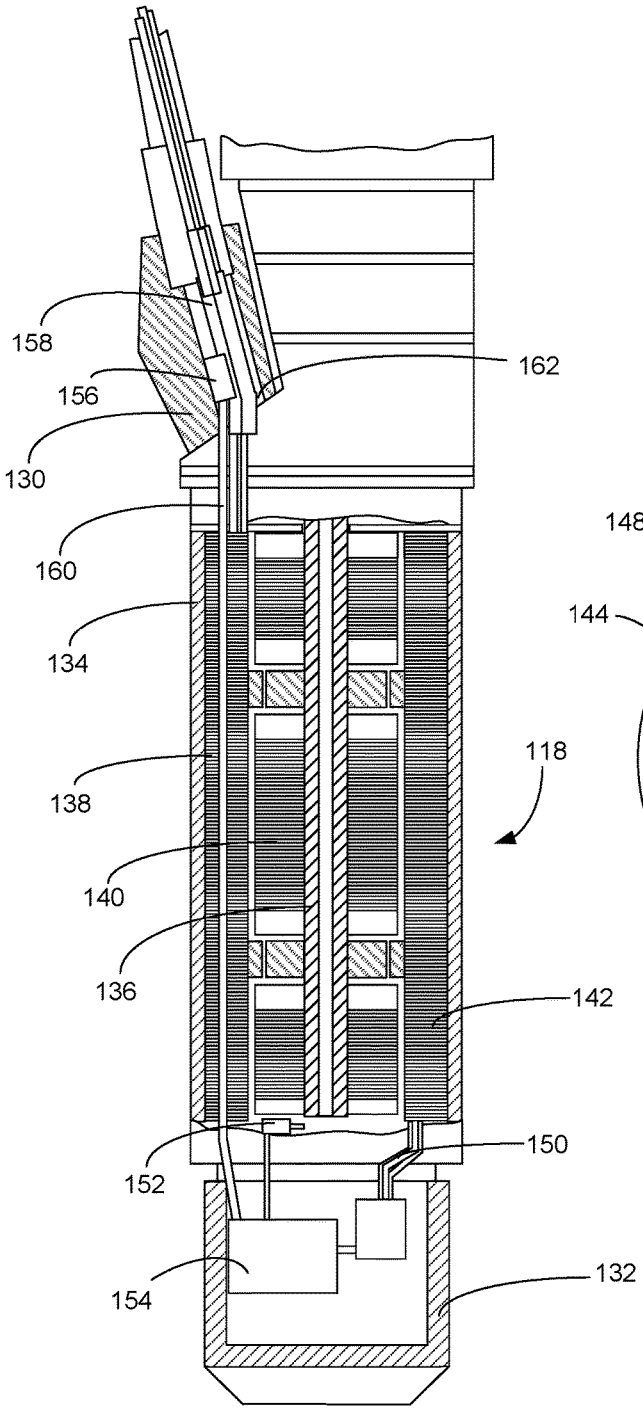
FIG. 2 is a cross-sectional depiction of the motor and pothead connector of the electric submersible pump of FIG. 1.

Turning to FIG. 2, shown therein is a partial cross-sectional view of the motor 118, sensor module 132 and pothead 130. The motor 118 includes a motor housing 134, a shaft 136, a stator assembly 138, and a rotor 140. The stator assembly 138 is located adjacent the interior surface of the motor housing 134 and remains fixed relative the motor housing 134. The stator assembly 134 includes a stator core 142 that is formed by passing magnet wire 144 through slots 146 in a plurality of stacked and compressed laminates 148 to form windings or coils.

Figure 3:
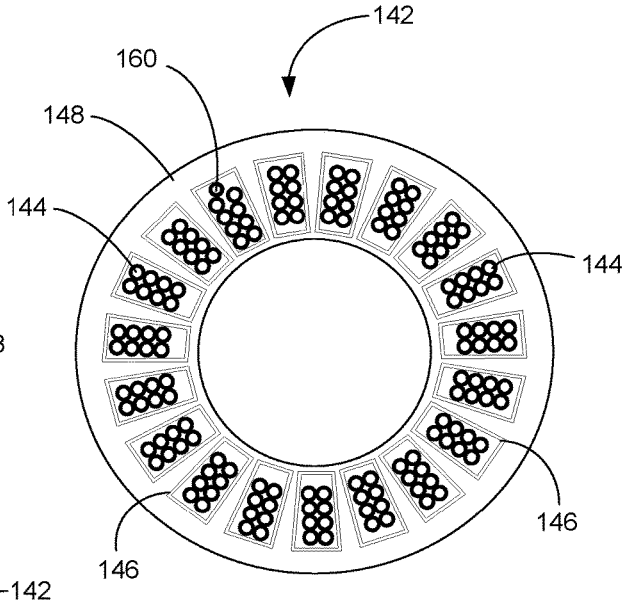
FIG. 3 is a cross-sectional view of the stator from the motor in FIG. 2, depicting the passage of the thermal probe sensor wire through the stator assembly.

FIG. 3 depicts the passage of the magnet wire 144 through the stator slots 146. Each stator coil is created by winding a length of magnet wire 144 back and forth though slots in the stator core 142. Each time the wire is turned 180° to be threaded back through an opposing slot 146, an end turn (not shown in FIG. 2) is produced, which extends beyond the length of the stator core 126. In induction type motors, power (usually three-phase AC power) is provided to the windings within the stator core 142, causing the stator assembly 138 to generate rotating magnetic fields, which induce currents and corresponding magnetic fields in the rotor 140, thereby causing the rotor 140 and the shaft 136 to rotate and drive the pump 116. In the case of a permanent magnet motor, three-phase AC power is provided to the windings within the stator core 142, generating rotating magnetic fields as in the induction motor. The rotor 140 of the permanent magnet motor, however, has a set of permanent magnets which cause the rotor 140 to rotate in the rotating magnetic fields generated by the sequentially energized stator assembly 138.

As illustrated in FIG. 2, the sensor module 132 is configured to receive electrical power and data signals from the motor 118. A wye-point or other power connection 150 can be used to provide power from the motor 118 to the sensor module 132. In some embodiments, the power connection 150 includes leads and terminals at the interface of the motor 118 and sensor module 132 that provide an electrical connection without the need for separate wiring. The motor 118 includes a motor temperature sensor 152 that is configured to measure the temperature of the motor 118. In some embodiments, the motor temperature sensor 152 is a thermocouple that detects the temperature of the motor lubricating oil or stator windings in the motor 118. The temperature sensor 152 is configured to output a signal representative of the internal operating temperature of the motor 118 to a processing board 154 within the sensor module 132.

Unlike prior art systems in which the temperature within the motor lead extension 124 is evaluated as a function of the remote temperature in the motor 118, the pumping system 100 includes a motor lead extension temperature sensor 156 positioned outside the motor 118. In the embodiment depicted in FIG. 2, the motor lead extension temperature sensor 156 is positioned in the pothead 130, near the leads or conductors 158 in the motor lead extension 124. The motor lead extension temperature sensor 156 is connected to a terminal junction 162 in the motor 118 which feeds to the sensor module 132 with a sensor wire 160. In some embodiments, the motor lead extension temperature sensor 156 is configured to be plugged directly into the conductors 158 within the terminal junction 162. The sensor wire may be one or more electrical wire(s), or may be an optical line. The sensor wire 160 extends from the terminal junction 162 to the sensor module 132 through the motor 118. In the embodiment depicted in FIGS. 2 and 3, the sensor wire 160 is routed through the stator core 142 with the magnet wire 144. In this way, the sensor wire 160 extends through one of the continuous slots 146 formed by the stack of aligned laminates 148. The sensor 'wire' may be of the embodiments of an insulated electrically conductive material or material designed to transmit light. The motor lead extension temperature sensor 156 is configured to measure the temperature of the motor lead extension 124, the motor lead extension conductors 158, and the other internal components within the pothead 130 and motor lead extension 124, and output a motor lead extension temperature signal to the sensor module 132.

In comparison to the motor temperature sensor 152 positioned within the motor 118, the motor lead extension temperature sensor 156 is capable of more accurately measuring the actual temperature of the interior of the motor lead extension 124 and internal components within the pothead 130. The signal produced by the motor lead extension temperature sensor 156 can be received and processed by the sensor module 132, which can then provide a signal to the motor drive 126. In application, the motor drive 126 can be configured to shut down the motor 118 or reduce the flow of electricity through the power cable 122 and motor lead extension 124 in the event the temperature measured by the motor lead extension temperature sensor 156 within the pothead 130 exceeds the high limit setpoint. The ability to more accurately detect the temperature within the motor lead extension 124 presents a significant advance over prior art systems that rely on temperature sensors that are located outside the motor lead extension 124 or pothead 130.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. An electric submersible pumping system configured to produce fluids from a well, the submersible pumping system comprising:

a motor drive;

an electric motor driven by the motor drive, wherein the motor comprises a stator assembly that includes:

a stator core formed by a plurality of laminates that each include a plurality of slots, wherein the plurality of laminates are aligned and stacked to produce a series of continuous stator slots; and magnet wire that extends through the continuous stator slots to form stator windings;

a terminal junction on an upper end of the electric motor;

a sensor module connected to a lower end of the electric motor;

a power cable, wherein an upper end of the power cable is connected to the motor drive;

a motor lead extension, wherein an upper end of the motor lead extension is connected to the power cable;

a pothead connected between the motor lead extension and the upper end of the electric motor;

a motor lead extension temperature sensor connected directly to the terminal junction, wherein the motor lead extension temperature sensor is configured to measure the temperature of the motor lead extension and output a motor lead extension temperature signal to the sensor module; and a sensor wire that extends between the motor lead extension temperature sensor and the sensor module through one of the series of continuous stator slots.

2. The electric submersible pumping system of claim 1, wherein the electric motor further comprises a motor temperature sensor located within the electric motor.

3. The electric submersible pumping system of claim 1, wherein the motor lead extension temperature sensor is located inside the pothead and configured to directly measure the temperature of the motor lead extension inside the pothead.

4. The electric submersible pumping system of claim 1, where the sensor module is connected to the motor through a power connection that provides power from the motor to the sensor module.

5. The electric submersible pumping system of claim 4, wherein the sensor module is connected to the motor drive by a communication signal.

6. The electric submersible pumping system of claim 5, wherein the motor drive is configured to adjust the output to the motor in response to the communication signal from the sensor module based on a measurement from the motor lead extension temperature sensor.

7. An electric submersible pumping system configured to produce fluids from a well, the submersible pumping system comprising:

a motor drive;

an electric motor driven by the motor drive;

a sensor module connected to a lower end of the electric motor;

a power cable, wherein a first end of the power cable is connected to the motor drive;

a terminal junction on an upper end of the electric motor;

a pothead connected to the motor;

a motor lead extension, wherein a first end of the motor lead extension is connected to a second end of the power cable, and wherein a second end of the motor lead extension comprises a plurality of conductors connected to the terminal junction through the pothead; and a motor lead extension temperature sensor connected directly into the plurality of conductors within the terminal junction.

8. The electric submersible pumping system of claim 7, wherein the motor lead extension temperature sensor is configured to directly measure the temperature of the motor lead extension inside the pothead.

9. The electric submersible pumping system of claim 8, wherein the electric submersible pumping system further comprises a sensor wire that extends between the motor lead extension temperature sensor and the sensor module.

10. The electric submersible pumping system of claim 9, further comprising a motor temperature sensor located inside the electric motor.

11. The electric submersible pumping system of claim 10, wherein the motor comprises a stator assembly that includes:

a stator core formed by a plurality of laminates that each include a plurality of slots, wherein the plurality of laminates are aligned and stacked to produce a series of continuous stator slots, and magnet wire that extends through the continuous stator slots to form stator windings.

12. The electric submersible pumping system of claim 11, wherein the electric submersible pumping system further comprises a sensor wire that extends between the motor lead extension temperature sensor and the sensor module through one of the series of continuous stator slots.

13. A method for operating an electric submersible pumping system that includes an electric motor, a motor drive, a power cable connected to the motor drive, and a motor lead extension connected to a terminal junction in the electric motor through a pothead between the electric motor and the power cable, the method comprising the steps of:

providing a motor lead extension temperature sensor connected directly to conductors within the terminal junction on the electric motor;

measuring a temperature of the motor lead extension with the motor lead extension temperature sensor; and outputting a motor lead extension temperature signal to a sensor module through a sensor wire connected to the sensor module, wherein the sensor wire passes through one of a series of continuous stator slots in the electric motor.

14. The method of claim 13, wherein the step of providing the motor lead extension temperature sensor further comprises providing the motor lead extension temperature sensor inside the pothead.

15. The method of claim 13, further comprising the step of adjusting the operation of the motor drive in response to the motor lead extension temperature signal.

16. The method of claim 15, wherein the step of adjusting the operation of the motor drive further comprises the step of reducing the electricity sent from the motor drive to the electric motor in response to a motor lead extension temperature signal that exceeds a high limit setpoint.

* * * * *